United States Patent [19]

Allen

[11] Patent Number: 4,754,629

[45] Date of Patent: Jul. 5, 1988

[54] SAFE RELOCKING SYSTEM

[76] Inventor: Mark L. Allen, 1776 E. 13th St., Brooklyn, N.Y. 11229

[21] Appl. No.: 119,078

[22] Filed: Nov. 10, 1987

[51] Int. Cl.[4] ..... E05B 63/00

[52] U.S. Cl. ..... 70/333 R; 70/1.5; 109/42

[58] Field of Search ..... 70/1.5, 1.7, 333 R; 109/41, 42, 23, 26, 30, 59 R; 361/171, 172

[56] References Cited

U.S. PATENT DOCUMENTS

| | | | |
|---|---|---|---|
| 3,111,022 | 11/1963 | Maynard | 70/1.5 |
| 3,947,837 | 3/1976 | Bitterice | 109/42 |
| 4,520,736 | 6/1985 | Crosby | 70/1.5 |
| 4,648,255 | 3/1987 | Gartner | 70/1.5 |
| 4,679,415 | 7/1987 | Spratt | 70/1.5 |

FOREIGN PATENT DOCUMENTS

| | | | |
|---|---|---|---|
| 3247200 | 6/1984 | Fed. Rep. of Germany | 109/42 |
| 2385872 | 12/1978 | France | 109/42 |

*Primary Examiner*—Robert L. Wolfe

*Attorney, Agent, or Firm*—William P. Keegan

[57] ABSTRACT

A safe relocking system that comprises a solenoid energized relocking bolt and an electrical printed circuit that is interposed in front of the safe locking mechanism and which controls actuation of the relocking bolt when altered or otherwise affected by an attack on the safe locking mechanism.

9 Claims, 2 Drawing Sheets

SAFE RELOCKING SYSTEM

FIELD OF THE INVENTION

This invention relates to safe locks, and more particularly to a safe relocking mechanism that prevents movement of a safe's boltwork from its locked position when an attempt is made to burglarize the safe.

BACKGROUND OF THE INVENTION

Doors of safes, vaults, strong rooms, and like security closures (hereinafter collectively referred to as safes) are provided with at least one and preferably a plurality of bolts that are reciprocated from a non-locking position to an extended locking position. When more than one bolt is provided, a boltwork comprising a group of links, cranks, and the like connect all bolts so that they may each be simultaneously moved when a single handle or wheel on the outside of the door is operated to extend the bolts to look the door or to withdraw the bolts to permit opening of the door. A locking device, usually a combination lock is also provided to secure the bolts in their extended locking positions. The lock contains its own bolt that will block or interfere with some part of the boltwork and prevent movement thereof and withdrawal of the bolts from their extended locking positions until such time as the combination lock is actuated to withdraw its bolt from its blocking position.

Burglars can, of course, attack locked safes by manipulating the combination lock until the correct combination is found, at which time the safe can be opened as with any authorized opening of the safe. Or a hole can be drilled through the safe door to enable a burglar to view the interior mechanism of the lock and line up the combination disks so that the lock bolt can be withdrawn in the usual way. However, the usual method is to physically or mechanically attack the combination lock as by punching, drilling, or burning the lock to gain access to the lock bolt and permit its movement out of its locking position. When it is so moved, the safe handle or wheel is operated to withdraw the bolts from their extended locking positions and thereby permit opening of the safe door.

To foil such efforts to crack a safe, a drill resistant hardplate may be provided under the combination lock or, in rare instances, around the lock. However, given the right tools and enough time, a skilled burglar can penetrate the hardplate and defeat its function of protecting the lock.

Also known in the art are relocking devices that embody an additional bolt that blocks some part of the boltwork and prevents operation of the safe handle or wheel to withdraw the locking bolts from their locking position. Such an additional bolt is normally held out of its blocking position but is spring biased to move into a blocking position when the safe combination lock is under attack. The mechanism for triggering operation of the relocking device bolt may be a movable plate that is moved when an attempt is made to punch, drill, or otherwise attack the combination lock. Or it may be a fragile glass plate mounted beneath the combination lock that will shatter when subjected to attack thereby freeing the relocking mechanism bolt to be biased to its relocking position. Both such relocking mechanisms are disclosed in U.S. Pat. No. 4,266,488. Other arrangements such as blocking the combination lock bolt when the lock is under attack are disclosed, for example, in U.S. Pat. No. 4,147,044.

All relocking mechanisms known to applicants are mechanical in nature as in the mentioned disclosures. As such they are designed for a particular safe and are incorporated therein when the safe is manufactured. They do not lend themselves for retrofitting to existing safes, nor do they lend themselves to a flexible or variable design for individual safes of a particular model of safe. Thus, burglars who are familiar with a particular model of safe will know exactly where, on that particular model of safe, the relocking bolt is located so it can be attacked as well as the primary combination lock bolt.

SUMMARY OF THE INVENTION

It is the object of the invention to provide an improved safe relocking mechanism.

It is another object of the invention to provide a relocking mechanism that facilitates random positioning of the relocking bolt.

It is still another object of the invention to provide an electrically controlled relocking mechanism.

In carrying out the invention, a printed circuit board is mounted on the inside of the safe door in front of the combination lock with the lock spindle passing through the board. A solenoid actuated bolt is provided to engage and block the safe boltwork when the solenoid is energized. A control module is electrically connected to the circuit board and the solenoid so that when the circuit pattern on the circuit board is broken or interrupted by an attempt to attack, as for example by drilling, the combination lock, the control module will cause the solenoid to be energized, thus relocking the safe. The printed circuit board may be in the form of a box enclosing the combination lock and having apertures therein for the lock mounting screws, the lock spindle, and the lock bolt. It may include other printed circuit boards that may be mounted at locations perceived to be vulnerable to a burglar's attempt to open the safe.

Features and advantages of the invention may be gained from the foregoing and from the description of a preferred embodiment thereof which follows.

DETAILED DESCRIPTION OF THE INVENTION

Figure 1:
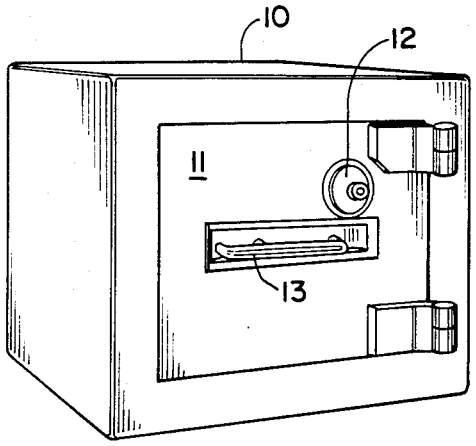
FIG. 1 is a perspective view of a simple safe.

In FIG. 1 a small safe 10 is shown having a safe door 11 hingedly mounted on the safe. A combination lock 12 is provided to lock the safe and a handle 13 is pivotally mounted on the door to extend and retract the bolts 14, 15, and 16 (FIG. 2) that normally maintain door 11 in a locked condition.

Looking at the inside of the safe door (FIG. 2), the boltwork 17 is shown to include an irregularly shaped member 20 which carries bolts 14 and 15. The bolts extend through apertures 21 and 22 provided in rim 23 which extends around the periphery of door 11. Member 20 is formed with a horizontal slot 24 through which bolt 25 projects so that the slot and apertures 21 and 22 guide member 20 for horizontal movement.

Figure 2:
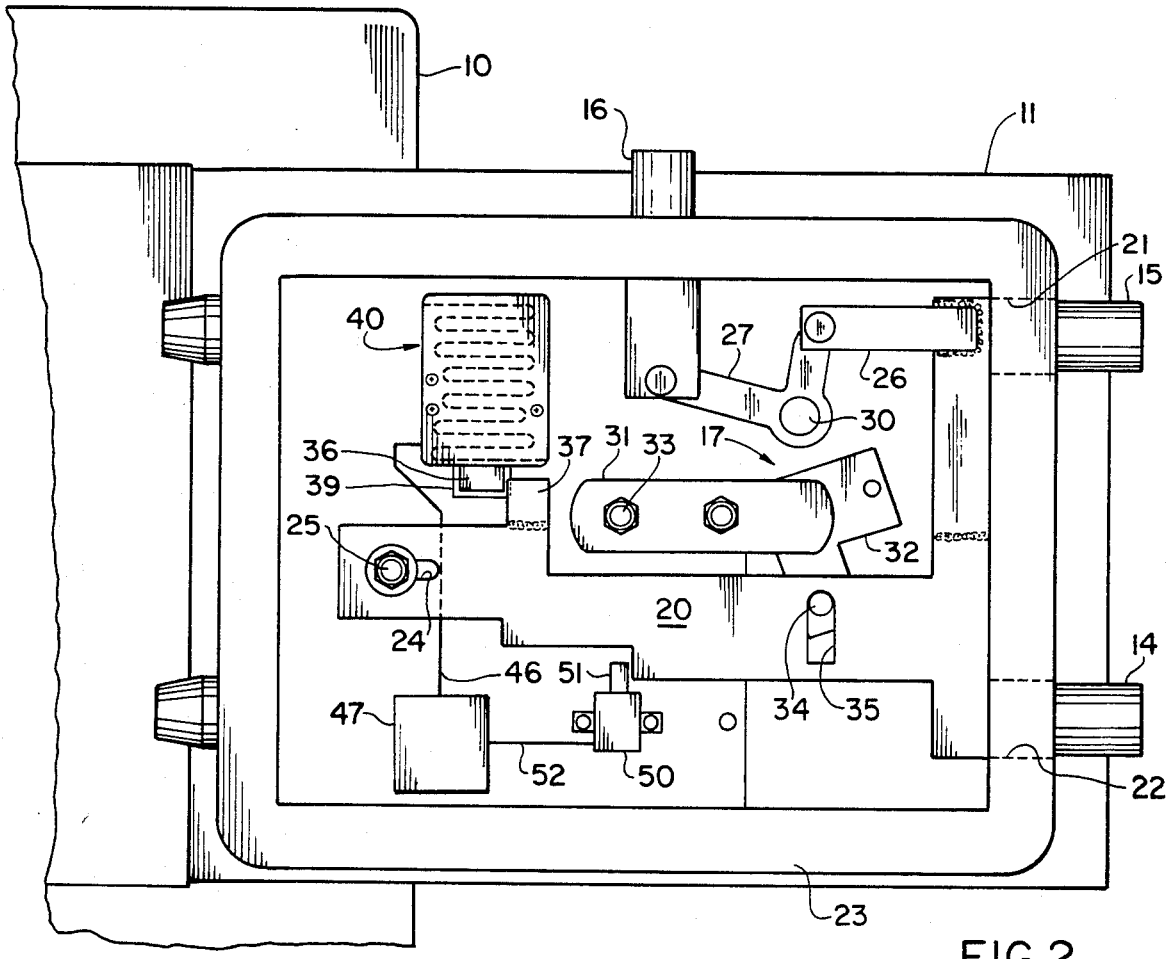
FIG. 2 is an elevational view of the interior of a safe door.

Member 20 is connected to vertical bolt 16 by a link 26, welded to member 20, and a crank 27 pivotally supported on door stud 30 and pivotally connected to link 26 and bolt 16. Member 20 is also connected to handle 13 by link 31 and angle member 32 joined thereto. Link 31 is secured to shaft 33 as is handle 13. When handle 13 is rotated counterclockwise (FIG. 1) link 31 is rotated clockwise (FIG. 2) and member 32 is moved downwardly and to the left as seen in FIG. 2. A fixed stub shaft 34 on member 32 slides in vertical slot 35 provided in member 20. The leftward movement of member 32 and shaft 34 moves member 20 to the left and unlocks the closed safe door provided bolt 36 of combination lock 12 is withdrawn and out of the path of the abutment 37 on member 20.

Figure 3:
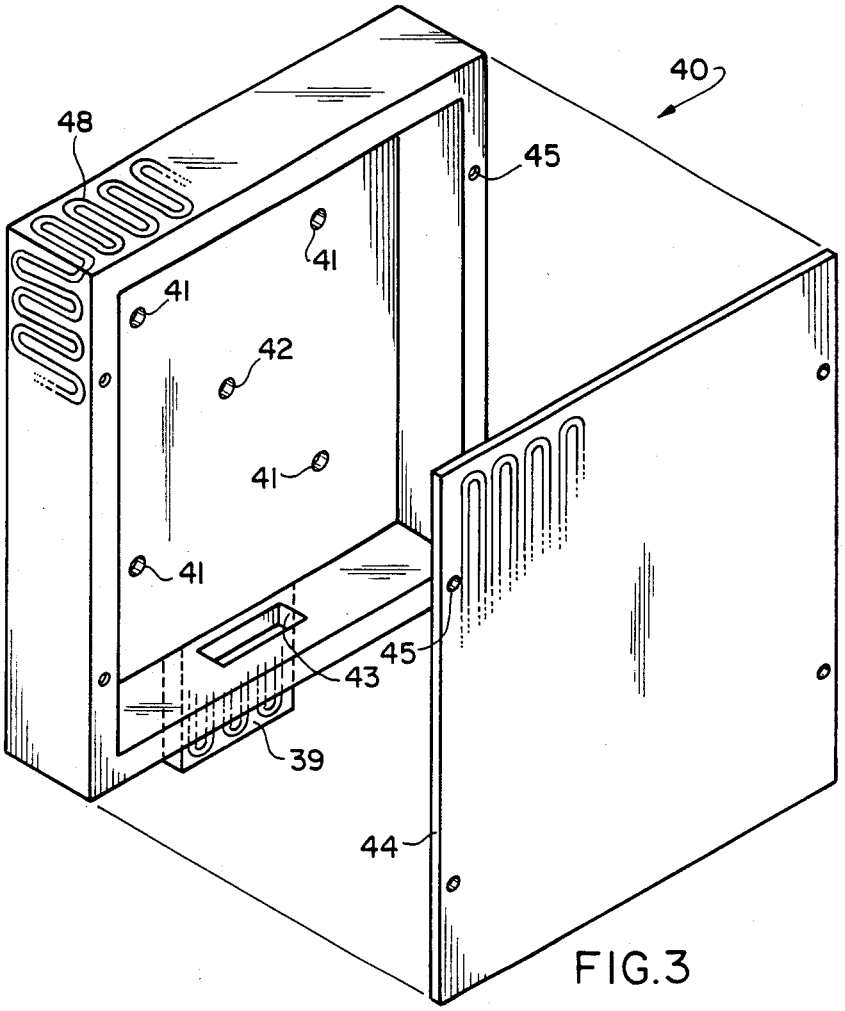
FIG. 3 is a perspective view of the lock enclosing printed circuit member of the relocking mechanism of the present invention.
Figure 4:
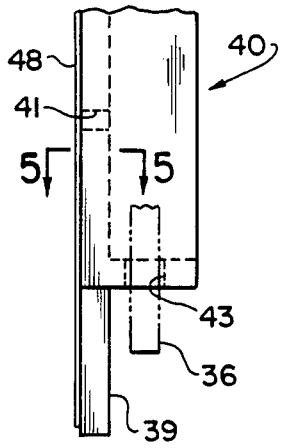
FIG. 4 is a fragmentary side elevational view of the printed circuit member shown in FIG. 3.
Figure 5:
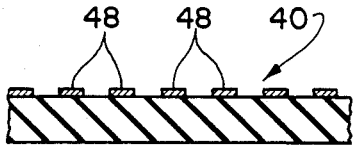
FIG. 5 is a fragmentary sectional view taken on line 5—5 of FIG. 4.

The relocking mechanism of the present invention includes an open-sided box 40 (FIG. 3) formed of an insulating material and provided with screwholes 41 through which screws (not shown) will secure box 40 and combination lock 12 to the interior of door 11. Box 40 also will be provided with an aperture 42 through which the spindle of lock 12 will project to the outside knob which rotates the interior lock parts, and an aperture 43 through which lock bolt 36 projects. It will be noted that box 40 is provided with a tab 39 that extends in front of lock bolt 36. As will be seen, the provision of tab 39 protects against an attack directly on lock bolt 36 just as box 40 protects against an attack on the combination lock. Though a box as described will generally be satisfactory, it may in certain applications totally enclose combination lock 12. In such a case a cover plate 44 also of insulating material will be provided to form a completely enclosed box. Appropriate screwholes 45 will be provided to enable cover plate 44 to be secured to box 40.

Box 40 will be provided with a printed detector circuit 48 that is a continuous circuit and covers all five sides of the box, including tab 39, in a labyrinthine pattern that does not allow box 40, or tab 39, to be drilled without interrupting the circuit. If a cover plate 44 is provided it also will be provided with a printed circuit that will be integrated into the continuous circuit provided on box 40. Similarly, a printed circuit plate could be mounted any place within safe 10 that is perceived to be vulnerable to a burglar's attack, and its circuit also would be integrated into the continuous circuit 48 provided on box 40.

Figure 6:
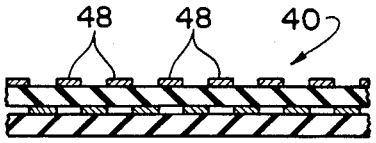
FIG. 6 is a fragmentary sectional view, similar to FIG. 5, showing another embodiment of the invention.

To minimize the liklihood that a narrow diameter drill will find a path between the conductors of circuit 48, or only partially cut the conductor, so that circuit 48 is not interrupted, box 40 could be provided with several layers (See FIG. 6) so that if the conductors of one layer are not cut the conductors of another layer will be. In this way it will be assured that circuit 48 will be interrupted when an attempt is made to drill combination lock 12.

Returning to FIG. 2, the printed circuit 48 is shown connected by an electrical cable 46 to a monitoring network module 47 containing suitable circuitry and a power source, i.e., batteries, by which the solenoid 50 is powered. The armature 51 of solenoid 50 is spring biased to a retracted or non-blocking position, but when the solenoid is energized the armature 51 is projected to the position shown in the drawing and so becomes the relocking bolt that prevents the main safe bolts 14, 15, and 16 being withdrawn to an unlocked position. A spring biased pin (not shown) mounted on the solenoid housing engages a slot or aperture provided in armature 51 when the armature is projected to its locking position, i.e., the position shown in FIG. 2. This pin thus prevents armature 51 being reset to its non-locking position should the batteries become discharged or disconnected from the solenoid after the solenoid is energized to effect a relocking operation.

Figure 7:
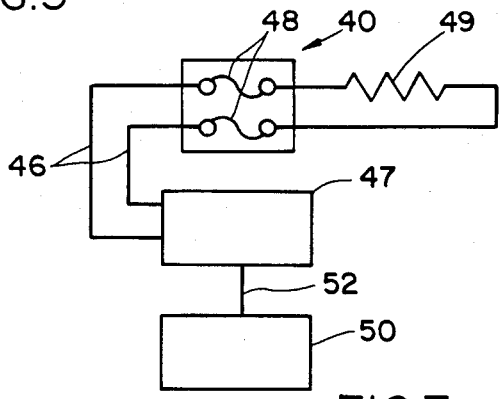
FIG. 7 is a simplified schematic electrical circuit diagram of the invention.

The electrical components of the system are connected in a circuit as schematically illustrated in FIG. 7. Each loop of the printed circuit 48 comprises two parallel conductors. One end of each conductor is connected to appropriate circuitry in monitoring network module 47 while the other ends are connected to a fixed resistance 49 that is located remotely from box 40 within the safe. The circuitry of the monitoring network is adjusted to recognize a current value in the circuit based on the value of the fixed resistance, and thus it will respond to a change in that current value caused either by a short circuit between the parallel conductors or an open circuit in either of them resulting from an attempt to drill through box 40. In either case, the circuitry will cause relocking solenoid 50 to be energized to relock the safe. Instead of two parallel conductors, a single conductor could be printed on box 40. With such an arrangement, remote resistance 49 would not be provided and the system would respond only to a break in printed circuit 48.

It is clear that since solenoid 50 is connected to monitoring network 47 only by an electrical cable 52, the solenoid can be positioned at any location so as to block movement of boltwork 17. Thus, the location of solenoid 50 may vary for different safes of the same design, and a burglar familiar with the design of a safe would never know the location of the relocking solenoid in any one safe.

It is to be understood that many apparently different embodiments of the invention could be made without departing from the spirit and scope of the invention. For example, in the description of the invention it was stated that the solenoid armature was spring biased to a non-locking position and that it only assumed a locking position when the solenoid was energized. This is preferred since power is expended only when the relocking device is called into play, a rare occurrance. The solenoid armature could be held out of its relocking position by energizing the solenoid and spring biased into relocking position when the solenoid is deenergized. Also, the solenoid could be powered by an external source of energy so that conserving battery power would not be a consideration. In such a case, the solenoid would be energized continuously to keep its armature out of a relocking position, and when the circuitry of monitoring network module 47 detects an attack on the safe, the solenoid would be deenergized and its armature spring biased into the relocking position. The labyrinthine pattern of the detector circuit could be different from the pattern disclosed, or some other form or type of circuit could be provided instead. Also, as previously noted, the detector circuit 48 could be provided at additional positions within the safe perceived to be vulnerable to attack. For example, monitor network module 47 could be protected against attack by a detector circuit. Thus the specification and the accompanying drawing should be intepreted in an illustrative rather than a limiting sense.

What is claimed is:

1. In a safe enclosure having door means to be selectively locked, bolt means movable from a retracted non-locking position to an extended position wherein said door means is locked, means connected to said bolt means to move the same between the retracted and the extended positions, and a door lock mechanism mounted on the interior of said door means including a bolt member movable between a retracted position and an extended position wherein it blocks said bolt means and prevents movement thereof from the extended locking position to the retracted position, a relocking system comprising: solenoid means; second bolt means actuatable by said solenoid means and movable between a non-blocking position and a blocking position wherein it blocks said bolt means and prevents movement thereof to the non-locking position; and circuit means for controlling energization of said solenoid means, said circuit means including a detector circuit means mounted between said door lock mechanism and the interior of said door means, and a circuit monitoring network to control said solenoid means to move said second bolt means to a blocking position when said detector circuit is altered by an attempt to attack said door lock mechanism.

2. A relocking system according to claim 1 wherein said detector circuit means extends between the extended bolt of said door lock mechanism and the interior of said door means.

3. A relocking system according to claim 1 including detector circuit means mounted around the top and sides of said door lock mechanism.

4. A relocking system according to claim 3 wherein said detector circuit means extends between the extended bolt of said door lock mechanism and the interior of said door means.

5. A relocking system according to claim 3 including a detector circuit means that covers the back of said door lock mechanism.

6. A relocking system according to claim 5 wherein said detector circuit means extends between the extended bolt of said door lock mechanism and the interior of said door means.

7. A relocking system according to claim 1 wherein said circuit monitoring network includes circuit element means remotely mounted within the safe to facilitate monitoring of any alteration in said detector circuit means.

8. A relocking system according to claim 1 wherein said detector circuit means comprises a single conductor arranged in a labyrinthine pattern each end of which is connected to said circuit monitoring network.

9. A relocking system according to claim 1 wherein said detector circuit means comprises a pair of parallel conductors arranged in a labyrinthine pattern, one end of each conductor being connected to said circuit monitoring network and the other end of each conductor being connected to circuit element means located within the safe remotely from said detector circuit.

* * * * *